US006354206B1

(12) United States Patent
Heiler et al.

(10) Patent No.: US 6,354,206 B1
(45) Date of Patent: Mar. 12, 2002

(54) PRINTING MACHINE CYLINDER AND CLAMPING DEVICE FOR FIRMLY CLAMPING A CYLINDER PACKING

(75) Inventors: Peter Heiler, Forst; Frank Kropp, Mauer; Jürgen Rothaug, Nussloch, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/484,782

(22) Filed: Jan. 18, 2000

(30) Foreign Application Priority Data

Jan. 18, 1999 (DE) ..... 199 01 703

(51) Int. Cl.[7] ..... B41F 27/06

(52) U.S. Cl. ..... 101/415.1; 101/378; 101/409; 101/246; 271/277

(58) Field of Search ..... 101/378, 408, 101/409, 410, 411, 412, 415.1, 246; 271/82, 85, 204, 205, 206, 268, 277

(56) References Cited

U.S. PATENT DOCUMENTS 3,557,695 A * 1/1971 Preuss ..... 101/415.1
3,658,002 A * 4/1972 Preuss ..... 101/378
4,475,459 A * 10/1984 Wanke et al. ..... 101/410
5,181,469 A 1/1993 Merkel et al. ..... 101/415.1
5,325,778 A * 7/1994 Hartung et al. ..... 101/415.1
5,642,669 A * 7/1997 Becker ..... 101/415.1

FOREIGN PATENT DOCUMENTS

| | | |
|---|---|---|
| DE | 41 28 994 C2 | 7/1992 |
| DE | 42 14 206 A1 | 11/1993 |
| DE | 43 00 099 C1 | 12/1993 |
| DE | 42 38 121 C2 | 5/1994 |
| DE | 295 06 150.2 | 7/1995 |
| JP | 2-104235 | 8/1990 |

* cited by examiner

*Primary Examiner*—Leslie J. Grohusky
(74) *Attorney, Agent, or Firm*—Herbert L. Lerner; Laurence A. Greenberg; Werner H. Stemer

(57) ABSTRACT

A clamping device for firmly clamping a cylinder packing or covering on a printing machine cylinder, the clamping device having a clamping seat, a clamping jaw cooperating therewith, and an eccentric shaft, includes a support wherein the eccentric shaft and the clamping jaw are jointly mounted, the support being adjustable alternatively into a first support position and into a second support position relative to the clamping seat; and a printing machine having at least one clamping device with the foregoing construction.

9 Claims, 4 Drawing Sheets

PRINTING MACHINE CYLINDER AND CLAMPING DEVICE FOR FIRMLY CLAMPING A CYLINDER PACKING

BACKGROUND OF THE INVENTION

Field of the Invention

The invention relates to a clamping device for firmly clamping a cylinder packing or covering on a printing machine cylinder, the clamping device including a clamping seat, a clamping jaw cooperating therewith, and an eccentric shaft.

Such a clamping device is described, for example, in the published Non-prosecuted Japanese Utility Model Specification No. 2-104235. The trailing-edge clamping device shown in FIG. 2 of the aforementioned published specification for clamping printing plates includes a winding rod extending in the direction of the cylinder axis and having a clamping plate articulatedly connected thereto, the winding rod bearing an eccentric shaft for operating the clamping plate. In this clamping device, a clamping seat or support is formed directly on the winding rod. Neither the eccentric shaft nor the clamping plate is mounted in a support that is adjustable with respect to the clamping seat.

A drawback with respect to the operating convenience of this clamping device of the Japanese utility model is the rather small width of the opening between the clamping plate and the clamping seat, the printing plate being insertable into the opening only with great difficulty so as to attain the clamping position thereof.

Furthermore, there is described in the published German Patent DE 195 15 843 C1, corresponding to U.S. Pat. No. 5,642,669 to Becker, a device for clamping a printing plate on a plate cylinder, which does not, however, belong to the general type of clamping device mentioned in the introduction hereto.

Although the width of the opening thereof is sufficiently large, this clamping device of the German patent document has a drawback from another point of view. In order to release the end of the plate, pneumatic cylinders are required, by which a clamping element is pivotable counter to the action of clamping springs. In the case of this heretofore known device, manual release by a tool is not possible for the operator, because the clamping force of the clamping springs that has to be overcome is too high.

SUMMARY OF THE INVENTION

It is accordingly an object of the invention to provide a clamping device for firmly clamping a cylinder packing on a printing machine cylinder, the clamping device being operatable manually, and having a large opening width.

With the foregoing and other objects in view, there is provided, in accordance with one aspect of the invention, a clamping device for firmly clamping a cylinder packing or covering on a printing machine cylinder, the clamping device including a clamping seat, a clamping jaw cooperating therewith, and an eccentric shaft, comprising a support wherein the eccentric shaft and the clamping jaw are jointly mounted, the support being adjustable alternatively into a first support position and into a second support position relative to the clamping seat.

In accordance with another feature of the invention, the support is mounted in the printing machine cylinder so as to be pivotable about a support joint.

In accordance with a further feature of the invention, the clamping jaw is mounted in the support so as to be pivotable about a jaw joint.

In accordance with an added feature of the invention, the clamping device includes a spring borne by the support.

In accordance with an additional feature of the invention, the clamping jaw is returnable by the spring from a clamping position into a released position.

In accordance with yet another feature of the invention, the eccentric shaft has a safeguard against rotation assigned thereto for blocking rotation of the eccentric shaft when the support is in the first support position, and for enabling rotation of the eccentric shaft when the support is in the second support position.

In accordance with yet a further feature of the invention, the eccentric shaft is formed with a circumferential flat which, when the support is in the first support position, is located opposite a stop face on the outside of the support and formlockingly locks the rotation of the eccentric shaft.

In accordance with yet an added feature of the invention, the eccentric shaft, on at least one shaft end thereof, has a tapered shaft extension, a side face of the shaft extension forming the flat.

In accordance with yet an additional feature of the invention, the clamping device includes a coulisse assigned to the eccentric shaft, the coulisse being disposed on the printing machine cylinder and having a groove with an inner face forming the stop face, the coulisse having a widening of the groove which, when the support is in the second support position, enables the rotation of the eccentric shaft.

In accordance with another aspect of the invention, there is provided a printing machine having at least one clamping device with at least one of the foregoing features.

Thus, the clamping device according to the invention for firmly clamping a cylinder packing on a printing machine cylinder, having a clamping seat and a clamping jaw cooperating with the latter, and having an eccentric shaft, is distinguished by the fact that the eccentric shaft and the clamping jaw are jointly mounted in a support which can be adjusted alternatively into a first support position and a second support position relative to the clamping seat.

With this clamping device, a two-stage clamping operation may be implemented. In a first stage, the clamping jaw can be adjusted by a manual adjustment of the support from a wide-open jaw position with good accessibility for the insertion of one edge of a cylinder packing into a less-open jaw position. In the less-open jaw position, the clamping jaw does not yet exert full clamping action on the cylinder packing. However, the latter is secured against slipping out of the clamping position thereof. In a second stage, the clamping jaw is adjustable by a manually performable rotation of the eccentric shaft from the less-open jaw position into a completely closed jaw position with full clamping effect. The clamping device permits distortion-free and in-register firm clamping even of cylinder packings without a bent-over edge, which provides a precondition for subsequent uniform tensioning of the cylinder packing in the circumferential direction of the printing machine cylinder.

The following embodiments constitute developments of the clamping device according to the invention which are particularly advantageous in construction terms and ensure high operating security.

One embodiment is distinguished by the fact that the support is mounted in the printing machine cylinder so that it can be pivoted about a support joint.

A further embodiment is distinguished by the fact that the clamping jaw is mounted in the support so that it can be pivoted about a jaw joint.

A further embodiment is distinguished by the fact that the support bears a spring.

A further embodiment is distinguished by the fact that the clamping jaw can be returned by the spring from a clamping position into a released position.

A further embodiment is distinguished by the fact that the eccentric shaft has a rotation safeguard assigned thereto, which blocks rotation of the eccentric shaft when the support is in the first support position, and which enables rotation of the eccentric shaft when the support is in the second support position.

A further embodiment is distinguished by the fact that the eccentric shaft has a circumferential flat which, when the support is in the first support position, is located opposite a stop face on the outside of the support.

A further embodiment is distinguished by the fact that, on at least one shaft end, the eccentric shaft has a tapered shaft extension, a side face of the shaft extension forming the flat.

A further embodiment is distinguished by the fact that the eccentric shaft has a coulisse assigned thereto that is disposed on the printing machine cylinder and has a groove with an inner face forming the stop face, the coulisse having a widening of the groove which, when the support is in the second support position, enables the rotation of the eccentric shaft.

The clamping device according to the invention is suitable for firmly clamping various types of cylinder packings, for example, foil or film-like cylinder packings or those formed as flexible plates, on printing machine cylinders of rotary printing machines. For example, with the clamping device, it is optionally possible for plates based on an aluminum carrier, plates formed of polyester material, as well as rubber blankets for varnishing or coating the whole area, to be clamped onto a coating cylinder.

The clamping device permits a reliable, frictional and/or formlocking firm clamping of the cylinder packings to be effected, without requiring the edges thereof to be bent over for this purpose. A good frictional connection can be achieved by a directly clamping contact surface on the clamping seat, and/or the clamping jaw being roughened. In addition or as an alternative to these measures, a good formlocking clamping action can be achieved by the contact surface of the clamping seat and/or the contact surface of the clamping jaw being provided with knob-like formlocking elements which press into the cylinder packing.

Other features which are considered as characteristic for the invention are set forth in the appended claims.

Although the invention is illustrated and described herein as embodied in a clamping device for firmly clamping a cylinder packing on a printing machine cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
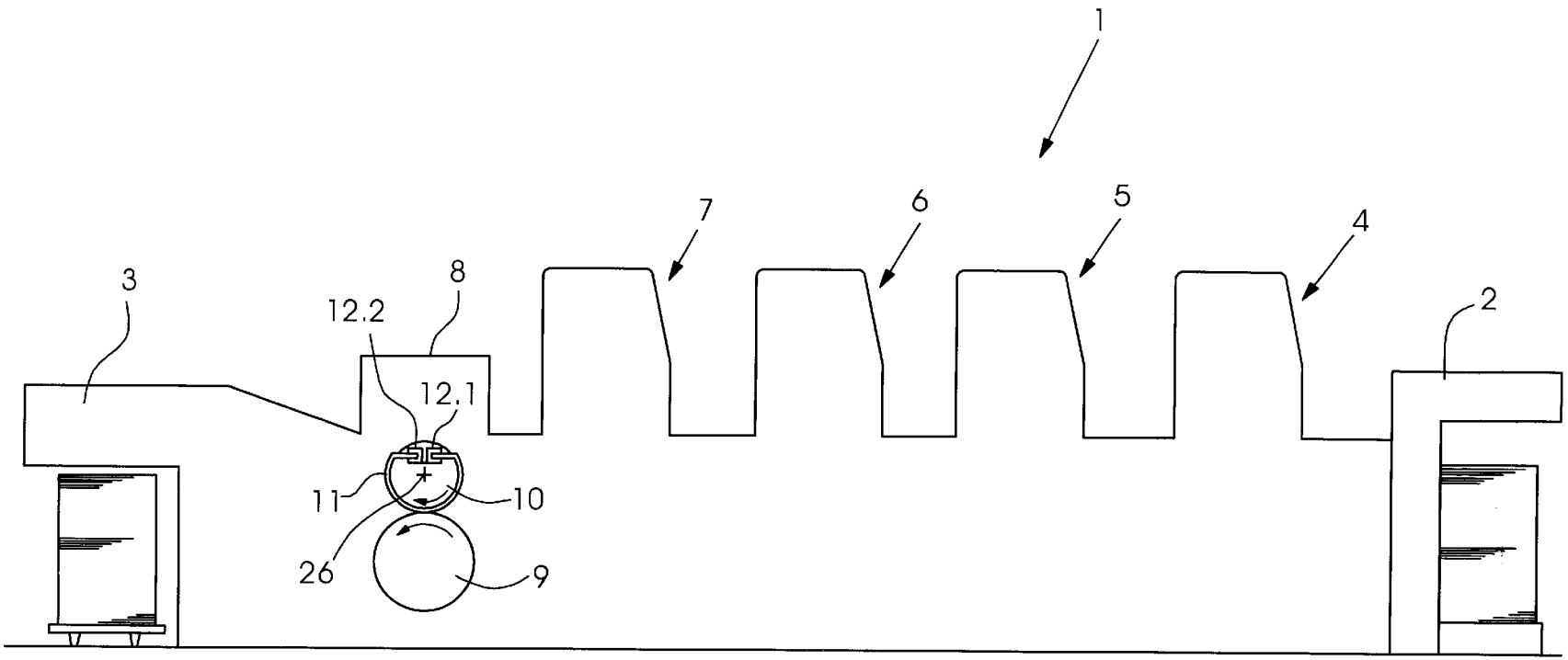
FIG. 1 is a diagrammatic side elevational view of a printing machine having a cylinder carrying a packing or covering on the outer cylindrical surface thereof, the packing being held at a trailing edge thereof by a clamping device.

Referring now to the drawings and, first, particularly to FIG. 1 thereof, there is shown therein a printing machine 1 represented as a rotary printing machine having a sheet feeder 2, a sheet delivery 3, a number of offset printing units, namely four printing units 4 to 7 in the illustrated embodiment, and a coating unit 8 disposed downline of the offset printing units 4 to 7 in a direction of transport of the printed material. The coating unit 8 includes a cylinder 9 carrying the printed material and having assigned thereto, at the circumference thereof, a cylinder 10 covered by a cylinder packing 11. The cylinder 9 is an impression cylinder assigned to the cylinder 10, and the cylinder 10 is a coating cylinder 10 for applying a printing ink, a varnish or a coating liquid to the printed sheet resting at that time on the cylinder 9.

A first clamping device 12.1 serves for firmly clamping a trailing edge of the cylinder packing 11, as viewed in the circumferential direction of the cylinder 10, and a second clamping device 12.2 serves for firmly clamping, or another fastening device serves for holding, a leading edge of the cylinder packing 11.

Figure 2:
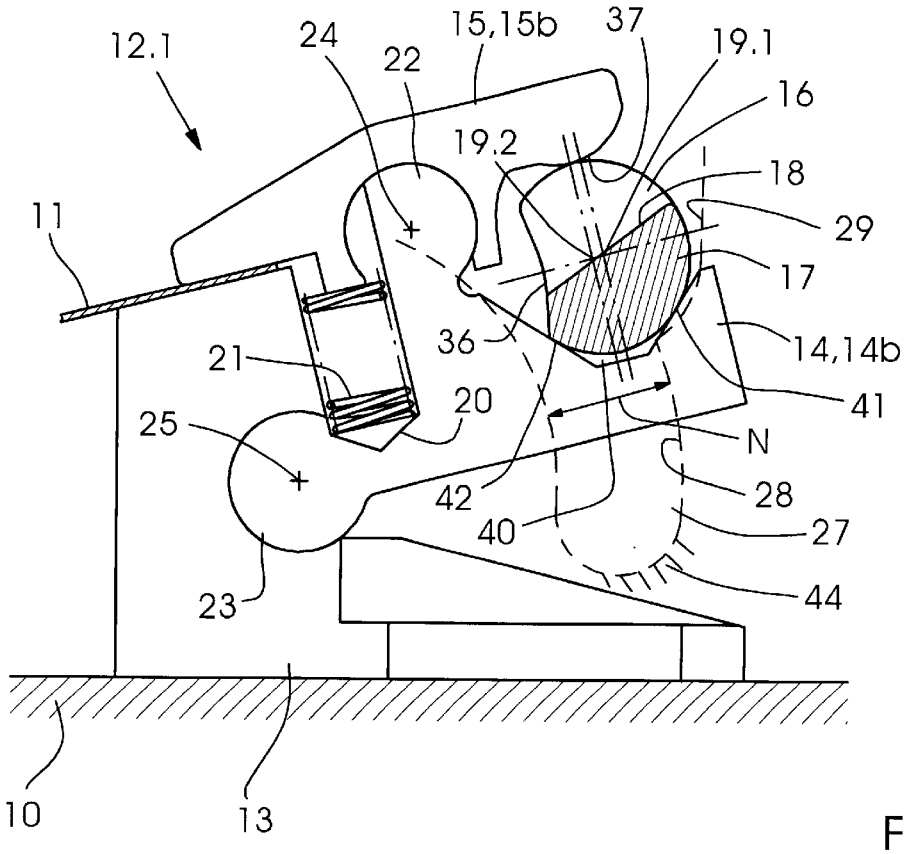
FIG. 2 is an enlarged fragmentary view of FIG. 1 showing the clamping device in a clamping position.

The construction of the clamping device 12.1 is illustrated in FIG. 2. The clamping device 12.1 includes a bearing block 13 that is fixed to the cylinder 10 and, for example, to a non-illustrated tensioning or tautening lever that is assigned to the cylinder 10 and tensions or tautens the cylinder packing 11 in the circumferential direction of the cylinder 10. The cylinder packing 11 is clamped between the bearing block 13 and a clamping jaw 15 mounted in the bearing block 13 so as to be pivotable via a plurality of articulated shafts 22 and 23.

The clamping jaw 15 is mounted on a support 14 so that it is pivotable relative to the latter via the first articulated shaft or jaw joint 22, and the support 14 is, in turn, mounted, via the second articulated shaft or support joint 23, so that it is pivotable relative to the cylinder 10 and to the bearing block 13. The clamping jaw 15 forms a rocker having a first lever arm, at the underside of which there is formed a clamping surface 30 (FIG. 4) that presses the cylinder packing 11 against a clamping seat 31 on the bearing block 13. Formed on the underside of a second lever arm of the clamping jaw 15 is a supporting bale or hoof ball 37, with which the clamping jaw 15 rests on a curved circumferential surface of an eccentric shaft 16.

The eccentric shaft 16 is rotatably mounted in the support 14, being inserted into a bearing groove 40 therefor that is shaped like a prismatic guide open at the top, so that the eccentric shaft 16 rests in a hollow extending along two parallel contact lines 41 and 42. The articulated axes 24 and 25, the clamping jaw 15 shaped like a profiled bar, the circumferentially flattened eccentric shaft 16, and the bearing groove 40 extend in an axially parallel direction relative to one another and to the axis of rotation 26 (FIG. 1) of the cylinder 10.

In addition to the clamping jaw 15 and the eccentric shaft 16, the support 14 further bears at least one spring 21, which is arranged to urge the clamping jaw 15 and the support 14 towards one another. The spring 21 is constructed as a helical spring that is inserted into an accommodating borehole 20 formed in the support 14 and presses against the first lever arm of the clamping jaw 15 at the underside thereof. It is preferable for a plurality of such springs 21 to be arranged in an axially parallel row, i.e., perpendicularly to the plane of FIG. 2, in the aforedescribed manner.

As a result of adjusting the support 14 by pivoting it about the second articulated shaft 23 from a first support position 14*a* (FIG. 4) into a second support position 14*b* (FIGS. 2 and 3) about axis 25, the clamping jaw 15 and, simultaneously, the eccentric shaft 16, on the one hand, and eccentric axes 19.1 and 19.2 thereof, respectively, on the other hand, are displaceable, relative to the clamping seat 31 that forms a counterpart to the clamping jaw 15 and that is fixed to the printing machine cylinder 10, from a first axial position (FIG. 4) into a second axial position (FIGS. 2 and 3) that is axially parallel to the first axial position. The clamping jaw 15 is pivotable, relative to the support 14 about axis 24, alternatively into a first jaw position 15*a* (FIGS. 3 and 4) and into a second jaw position 15*b* (FIG. 2), so that, in addition to the adjustment of the clamping jaw 15 relative to the cylinder 10, which is effected by the adjustment of the support 14 towards the cylinder 10, an additional ability to adjust the clamping jaw 15 relative to the support 14 is provided.

As the eccentric shaft 16 is rotated in a counterclockwise direction, the oval cross-sectional shape thereof has the effect of continuously increasing the clamping force of the clamping jaw 15, and permits the setting of the clamping force necessary for the respective cylinder packing 11 as a function of the thickness and compressibility of the latter. The oval cross-sectional shape of the eccentric shaft 16 results from two semicircles having radii $R_1$ and $R_2$ of equal size of, for example, 7 millimeters, respectively, the centers 19.1 and 19.2 of the semicircles being displaced an offset distance A in opposite directions, and the semicircles accordingly being displaced into one another.

Figure 3:
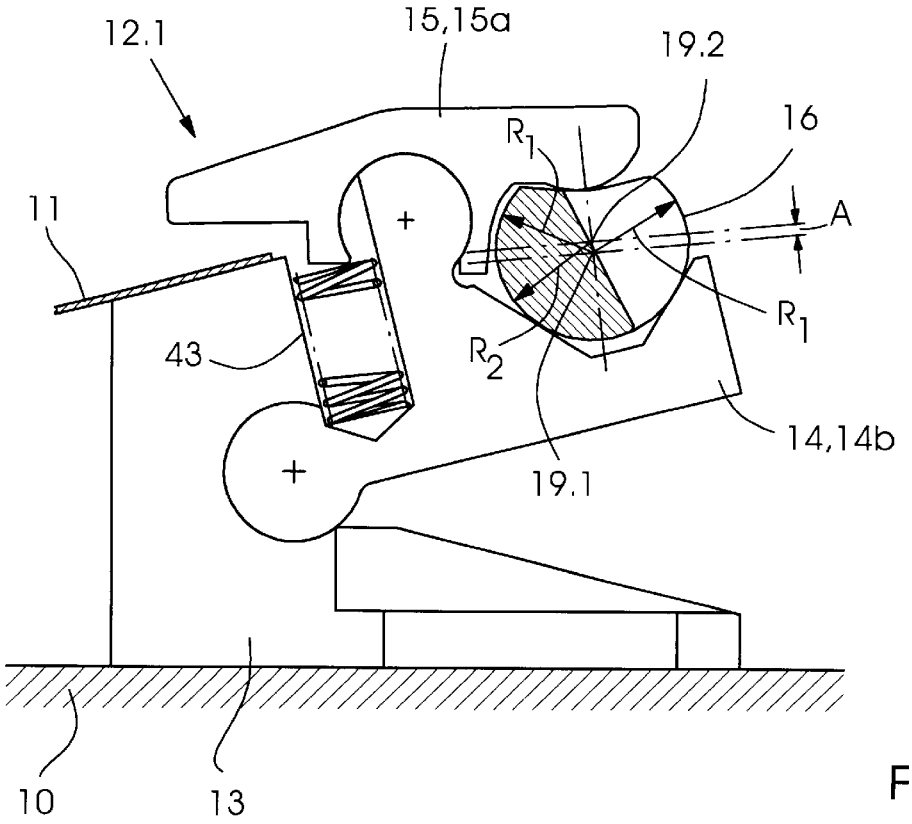
FIG. 3 is a view like that of FIG. 2 in a different operative phase of the clamping device wherein it is in a released position.

The eccentric shaft 16 is formed with a circumferential flat 36 that extends over the entire axial length of the eccentric shaft 16, and is slightly concavely curved, as can be seen from the cross-sectional view of the eccentric shaft 16. With reference to the same cross-sectional plane (image plane), the flat 36 extends approximately perpendicularly to that direction in which the two semicircles are pushed together the offset distance A to form the oval shape of the eccentric shaft 16. The radius of curvature of the circumferential concave flat 36 is greater than the radius of curvature of the convex supporting bale or hoof ball 37, so that the situation wherein the convex supporting bale or hoof ball 37 rests in the hollow of the concave flat 36 is avoided, and the supporting hoof ball or bale 37 rests on the flat 36 along a supporting line that is perpendicular to the plane of the figure or image plane, as shown in FIG. 3.

Figure 6:
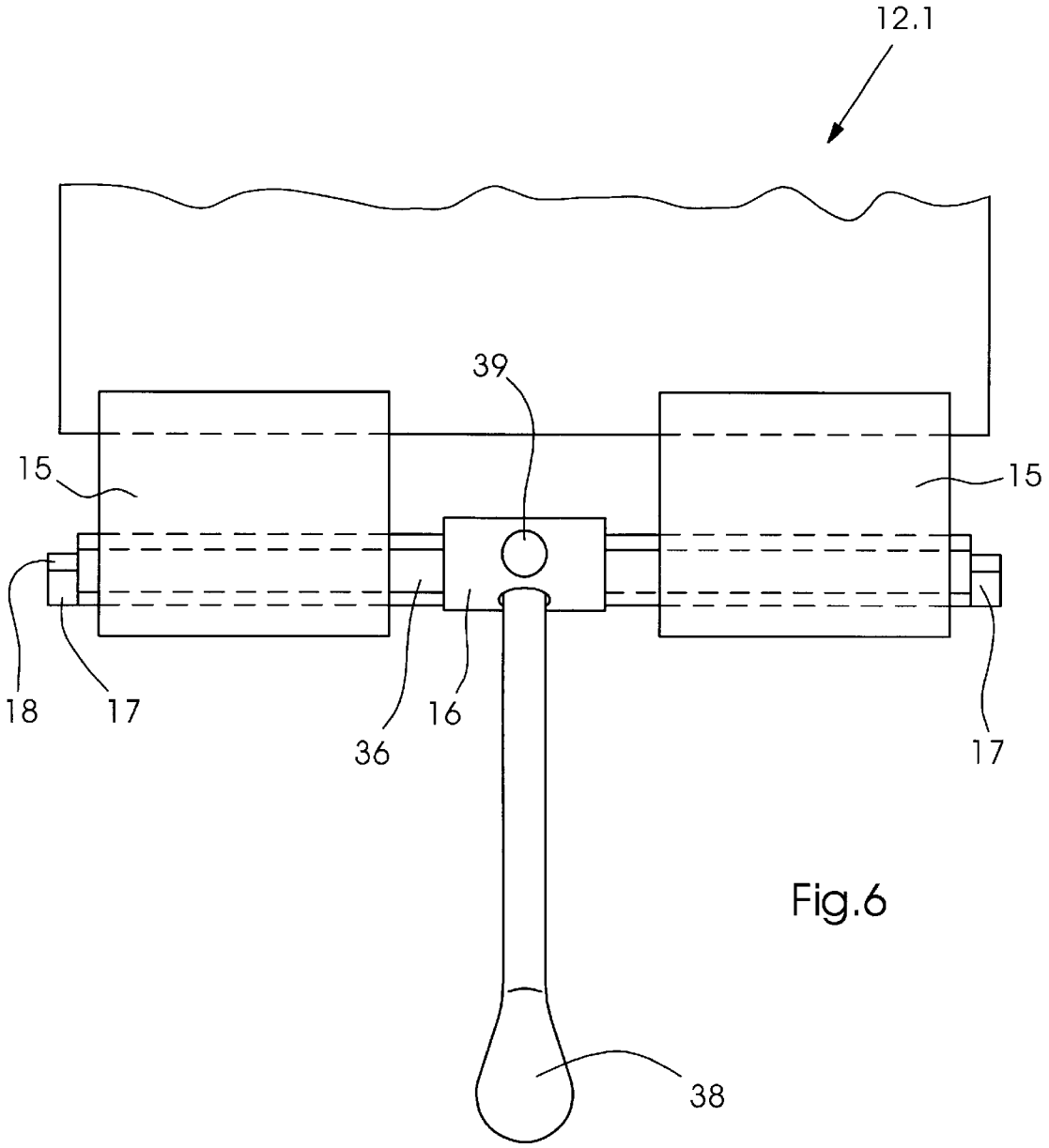
FIG. 6 is a top plan view, rotated 90° clockwise, of the clamping device illustrated in FIGS. 2 to 4.

Formed on each end of the eccentric shaft 16 is a shaft extension 17, the shaft extensions 17 serving to guide the eccentric shaft 16 on both sides (note FIG. 6). Each shaft extension 17 slides in the manner of a groove block in a respective slotted guide or coulisse 27. The coulisses 27 are formed on the cylinder 10 on both sides of the eccentric shaft 16, and, for example, on the bearing block 13 thereof or side walls 44 of the cylinder 10. The end shaft extensions 17 can be produced, for example, by milling the eccentric shaft 16 a milling depth down to the flat 18 and, for example, a milling width of 5 millimeters, by which the shaft extension 17 projects, the shaft extension 17 appearing to be approximately semicircular in a cross-sectional view, and the flat 18 on the shaft extension 17 extending at an oblique angle to the circumferential flat 36.

Figure 4:
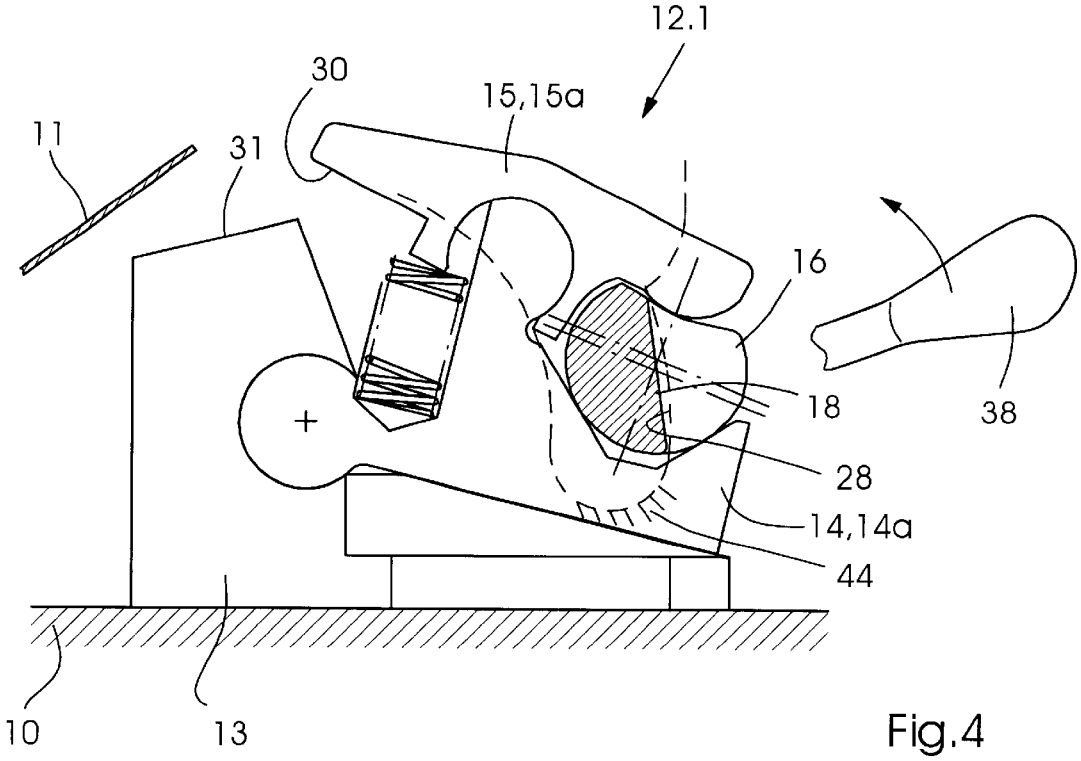
FIG. 4 is a view like those of FIGS. 2 and 3 in yet a further operative phase of the clamping device wherein it is in a wide open position.

A dimension, measured perpendicularly to the flat 18, up to the external rounding of the shaft extension 17 is smaller than a maximum dimension of the shaft extension 17, that extends parallel to the flat 18, so that a narrow cross-sectional extent and a broad cross-sectional extent of the shaft extension 17 result. The narrow cross-sectional extent is smaller than a nonwidened region of the coulisse 27 having a groove width N. In the longitudinal position thereof, the shaft extension 17 can be inserted into this nonwidened region of the coulisse 27, as is illustrated in FIG. 4. The broad cross-sectional extent of the shaft extension 17 is greater than the groove width N, so that rotation of the eccentric shaft 16 is blocked when the shaft extension 17 is located in the nonwidened region.

The coulisse 27 that extends in the manner of a circular arc about the axis 25 of the articulated shaft 23, has a groove widening 29 that permits rotation of the shaft extension 17 within the groove in the coulisse 27, from the longitudinal position of the shaft extension 17 into the tranverse position thereof.

Figure 5:
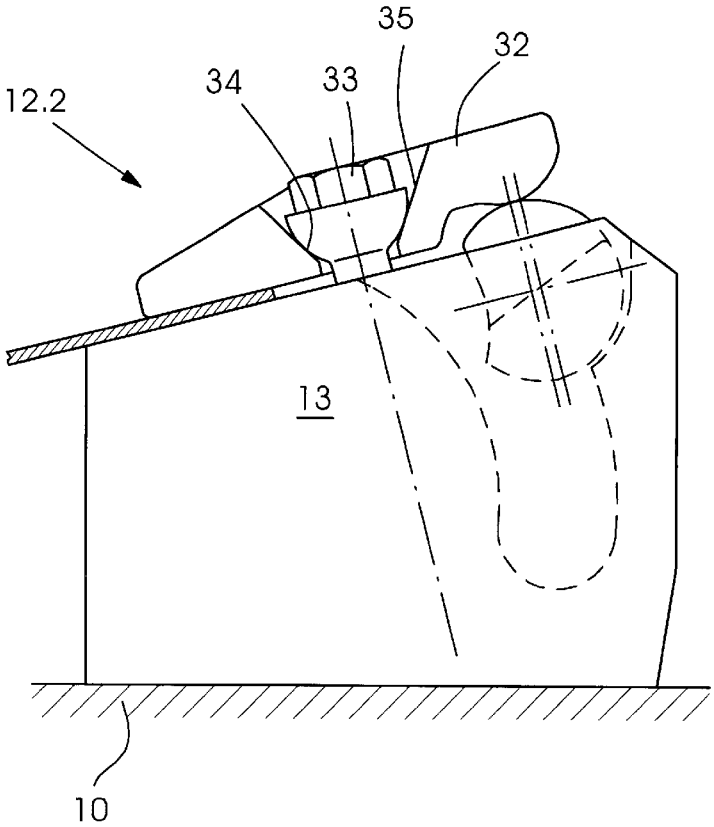
FIG. 5 is a view similar to those of FIGS. 2 to 4, showing another embodiment of the clamping device having a clamping jaw mounting that differs from the clamping jaw mounting shown in FIGS. 2 to 4.

FIG. 5 illustrates an alternative construction of the articulated shaft or pivot joint 22 of the embodiment of FIGS. 2 to 4, which is particularly beneficial in production terms. In this case, at least one screw 33 is screwed into the support 14, the underside of the head of the screw being rounded in an approximately hemispherical shape. The clamping jaw 32 that is used instead of the clamping jaw 15 in this alternative embodiment has a bore through which the screw 33 passes, the bore being formed with an inner annular chamfer 35 that is set at an angle to the axis of the screw and that, together with the rounding 34 of the screw head which rests on the inner chamfer 35, forms a swivel joint of the clamping jaw 32. It is preferable for a plurality of swivel joints of this type to be formed on the clamping jaw 32 in an axially parallel row perpendicular to the plane of the figure.

FIG. 6 illustrates the clamping device 12.1 in a plan view, some of the parts thereof having been omitted in the interest of better clarity. FIG. 6 shows that the eccentric shaft 16 has a number of clamping jaws 15 assigned thereto, and that the eccentric shaft 16 is provided with an annular bead located between the clamping jaws 15 and having one or more transverse bores 39 formed therein for the insertion of a handle 38 serving to rotate the eccentric shaft 16. Instead of the handle 38 and the insertion bore 39, other tools which can also be brought into formlocking connection with the eccentric shaft 16 can be used to rotate the eccentric shaft 16. In this regard, it is noted that a formlocking connection is one which connects two elements together due to the shape of the elements themselves, as opposed to a forcelocking connection, which locks the elements together by force external to the elements.

The functioning and operation of the clamping device 12.1 is described hereinbelow with reference to FIGS. 2 to 4:

In FIG. 4, the clamping device 12.1 is illustrated with the support 14 in the first support position 14*a* and with the clamping jaw 15 in the first jaw position 15*a*, the clamping jaw 15 being wide open, and the clamping surface 30 thereof being retracted from a position opposite the clamping seat 31, so that the edge of the cylinder packing 11 can be placed without difficulty onto the clamping seat 31. If the operator pulls the handle 38 upwards in order to rotate the eccentric shaft 16 in the counterclockwise direction, as indicated in FIG. 4, rotation of the eccentric shaft 16 in relation to a groove inner surface 28 forming a stop face 28 is blocked at times by the latter striking the flat 18, as long as the shaft extension 17 is located in the nonwidened region of the coulisse 27, and thus the flat 18 is located opposite the stop face 28.

The result, initially, is an adjustment of the support 14 without any rotation of the eccentric shaft 16 and thus without any adjustment of the clamping jaw 15, the support 14 being pivoted in the counterclockwise direction about the articulating shaft or joint 23 until the side surface or flat 18 has been displaced out of the position opposite the stop face 28, and the shaft extension 17 has been displaced into a groove widening 29 (note FIG. 2) which enables rotation of the eccentric shaft 16, whereafter, the clamping device 12.1 is in the position illustrated in FIG. 3. In this so-called released position, the clamping jaw 15 has already been pushed over the clamping seat 31 and the cylinder packing 11 resting on the latter, but has not yet been completely closed, so that any necessary fine corrections to the position of the cylinder packing 11 remain possible.

Pulling the handle 38 farther up effects a rotation of the eccentric shaft 16 in the counterclockwise direction against the restoring action of the spring 21, further pivoting of the support 14 being blocked by a striking of the bearing block 13 against a stop face 43. Due to the rotation of the eccentric shaft 16, the clamping jaw 15 is pivoted in a counterclockwise direction about the articulating shaft or swivel joint 22 until it firmly clamps the cylinder packing 11, and the clamping device 12.1 is adjusted from the slightly open position thereof illustrated in FIG. 3 into the fully closed clamped position thereof illustrated in FIG. 2.

An advantage with regard to the clamping device 12.1 is that the entire clamping operation is executed with a single operating movement, i.e., by pulling the handle 38 upwards, the clamping movement being subdivided into two stages. In the first stage, the clamping eccentric 16 is blocked by the coulisse 27 and, guided by the coulisse 27, covers a comparatively great travel distance. In the second stage, the coulisse 27 enables the clamping eccentric 16 and thereby permits the actual clamping movement. Consequently, very good accessibility is provided for the insertion of the cylinder packing 11.

When the cylinder packing 11 is being clamped onto the cylinder 10, the clamping device 12.1 holding the leading edge can be closed first and, either before or after the latter, the clamping device 12.2 holding the trailing edge of the cylinder packing 11 can be closed. When both clamping devices 12.1 and 12.2 have been closed, they can be moved towards one another approximately in the circumferential direction, so that the cylinder packing 11 wrapping around the cylinder 10 is tautly tensioned.

We claim:

1. In combination with a printing machine cylinder, a clamping device for firmly clamping a cylinder packing or covering on the printing machine cylinder, the clamping device comprising:

a clamping seat;

a clamping jaw cooperating with said clamping seat;

an eccentric shaft;

a support having a support joint;

said eccentric shaft and said clamping jaw mounted in said support;

said support adjustable alternatively into a first support position and into a second support position relative to said clamping seat; and said support mounted in the printing machine cylinder and pivotable about said support joint.

2. The combination according to claim 1, wherein said clamping jaw has a jaw joint and is mounted in said support pivotable about said jaw joint.

3. The combination according to claim 1, including a spring borne by said support.

4. The combination according to claim 3, wherein the clamping jaw is returnable by said spring from a clamping position into a released position.

5. The combination device according to claim 1, wherein the eccentric shaft has a safeguard against rotation assigned thereto for blocking rotation of the eccentric shaft when said support is in said first support position, and for enabling rotation of the eccentric shaft when said support is in said second support position.

6. The combination according to claim 5, wherein the printing machine cylinder has a stop face and the eccentric shaft is formed with a circumferential flat which, when said support is in said first support position, is located opposite the stop face and formlockingly locks the rotation of the eccentric shaft.

7. The combination according to claim 6, wherein the eccentric shaft, on at least one shaft end thereof, has a tapered shaft extension, a side face of said shaft extension forming said flat.

8. The combination according to claim 6, including a coulisse assigned to the eccentric shaft, said coulisse being disposed on the printing machine cylinder and having a groove with an inner face forming said stop face, said coulisse having a widening of said groove which, when said support is in said second support position, enables the rotation of the eccentric shaft.

9. A printing machine having a printing machine cylinder and at least one clamping device according to claim 1.

* * * * *